United States Patent [19]

Lanters et al.

[11] Patent Number: 4,937,100

[45] Date of Patent: Jun. 26, 1990

[54] PROCESS FOR THE PRODUCTION OF PULPED CELLULOSE MATERIAL, IN PARTICULAR WOOD FIBERS, FOR THE PRODUCTION OF FIBERBOARD AND PRODUCTS PRODUCED

[75] Inventors: Henricus J. Lanters, Eindhoven; Jacobus J. M. Bremmers, Tegelen, both of Netherlands

[73] Assignee: Hoechst Aktiengesellschaft, Frankfurt am Main, Fed. Rep. of Germany

[21] Appl. No.: 230,049

[22] Filed: Aug. 9, 1988

[30] Foreign Application Priority Data

Aug. 22, 1987 [DE] Fed. Rep. of Germany ..... 3728123

[51] Int. Cl.[5] ..... B05D 7/06

[52] U.S. Cl. ..... 427/212; 427/291; 427/325; 427/397

[58] Field of Search ..... 427/212, 325, 291, 397

[56] References Cited

U.S. PATENT DOCUMENTS 2,817,617 12/1957 Rogers ..... 427/212
4,503,115 3/1985 Hemels et al. ..... 428/281

FOREIGN PATENT DOCUMENTS 0166153 1/1986 European Pat. Off. .
0216269 4/1987 European Pat. Off. .
3609506 10/1986 Fed. Rep. of Germany .

OTHER PUBLICATIONS

Dust Collector Design; Perry's Chemical Engineers' (6th ed. 1985), McGraw-Hill Book Company; 20-81 to 20-89

*Primary Examiner*—Shrive Beck
*Assistant Examiner*—Alain Bashore
*Attorney, Agent, or Firm*—Foley & Lardner, Schwartz, Jeffery, Schwaab, Mack, Blumenthal & Evans

[57] ABSTRACT

A process is provided for the production of pulped cellulose material, preferably wood fibers, in particular up to a fiber length of 20 mm, with a high proportion of thermocurable resin, the process being suitable, in particular, for the production of fiber-containing moldings. In this process, the thermocurable resin, in aqueous, preferably alkaline solution, is added to a mixture of fiber particles and steam, and the steam is removed from the resin-coated fiber particles in a drier. The steam is removed from the mixture of steam and fiber particles after addition of the resin, and the fiber particles are subsequently dried in a drying stage to a moisture content of less than 12% by weight, in particular 3 to 10% by weight.

12 Claims, 1 Drawing Sheet

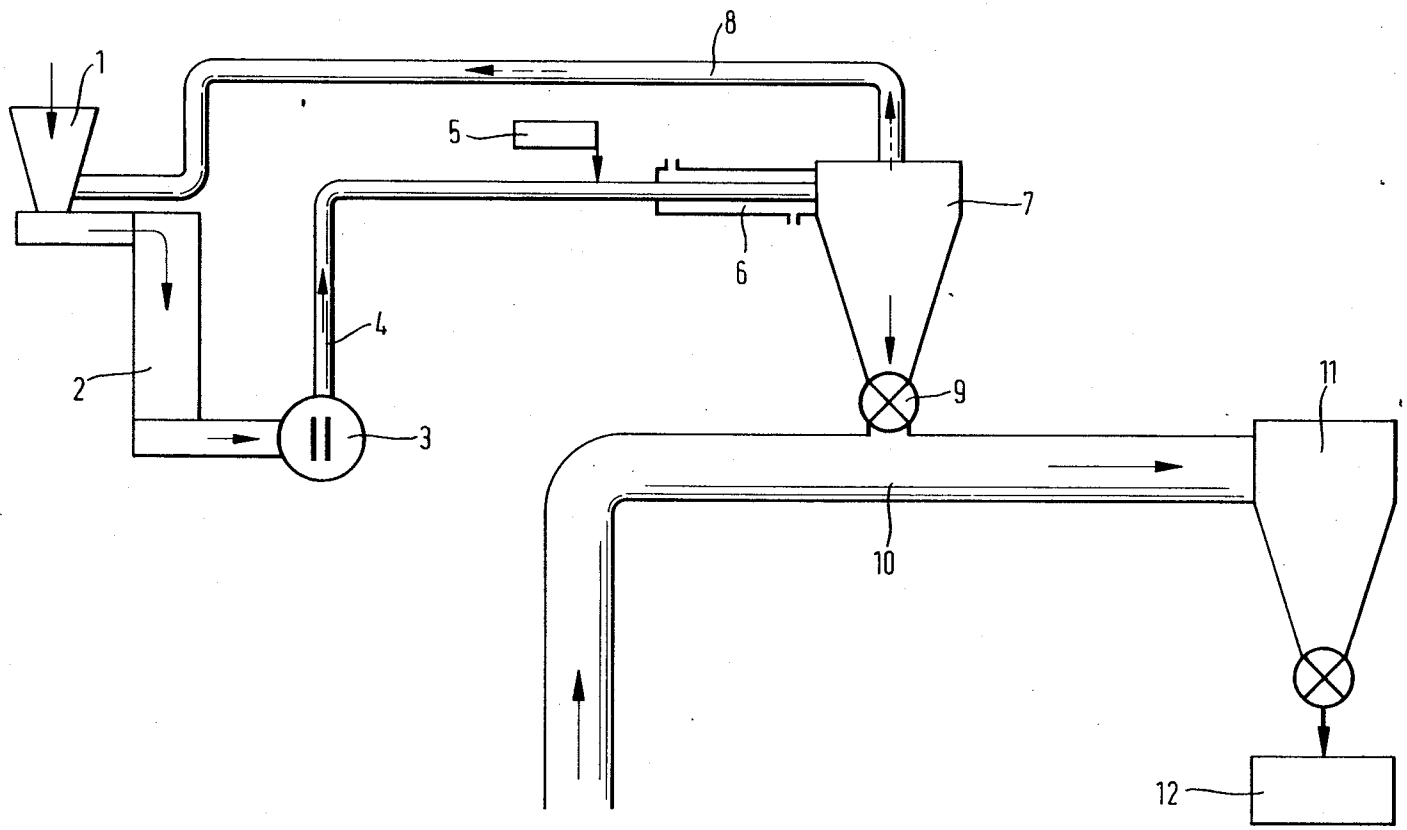
1
2
3
4
5
6
7
8
9
10
11
12

PROCESS FOR THE PRODUCTION OF PULPED CELLULOSE MATERIAL, IN PARTICULAR WOOD FIBERS, FOR THE PRODUCTION OF FIBERBOARD AND PRODUCTS PRODUCED

BACKGROUND OF THE INVENTION

The present invention relates to a process for the production of pulped cellulose material, in particular wood fibers, up to a fiber length of 20 mm, with a high proportion of thermocurable resin. The coated wood fibers are suitable for the production of decorative moldings, where they are initially shaped to form a fiber mat and then compressed at high temperature.

The process according to the present invention proceeds from known processes in which wood chippings are initially softened using steam and subsequently comminuted, for example, between two grinding disks, to form wood fibers having a length of up to 20 mm. An aqueous alkaline solution of a thermocurable resin is then applied to the moist wood fibers, and the coated wood fibers are dried, for example, using hot air, to a residual moisture, content of less than 15% by weight (see U.S. Pat. No. 4,503,115). When carrying out this known process, however, there is the danger of the resincoated particles sticking to the drying tube wall during drying and, in an extreme case, blocking the drying tube, which can easily cause autoignition.

It is also known to transport the wood fibers after the pulping station in a steam/air stream, to remove the major part of the steam stream from the wood fibers before applying the resin, to apply the aqueous resin solution to the fiber particles carried by the residual steam stream in a blow plant, and then to dry the coated wood fibers (see German Offenlegungsschrift No. 3,609,506). Although this process has the advantage that relatively little energy is necessary during drying, due to the previously reduced proportion of steam, there is a danger in this process of the resin solution mixing insufficiently with the wood fibers and of undesired pre-compression occurring, which can cause problems during further processing of the coated wood fibers.

For example, poor mixing of wood fibers with the resin can result in the formation, by drying resin drops, of glue nests in the finished board. These nests result in undesired reductions in the optical and technical quality. These disadvantages of the known process are particularly serious if relatively large amounts of resin, relative to the amount of wood fibers, are to be employed, as is disclosed, for example, in U.S. Pat. No. 4,503,115. A further disadvantage is that, with the use of large amounts of resin in accordance with the aforesaid patent, the line labeled 28 in the figure of Offenlegungsschrift No. 3,609,506 would become blocked with resin and fiber particles.

SUMMARY OF THE INVENTION

It is therefore an object of the present invention to provide a process which ensures uniform mixing of the fiber particles with the resin, even when large amounts of resin are used, relative to the amount of the fiber particles, and which obviates the danger of blockage (and consequent autoignition) of the drying tube by fiber particles adhering to one another.

It is also an object of the present invention to provide a process which entails inexpensive transport of the fiber particles, i.e., the process can be carried out at low equipment cost, and the energy expense is relatively low, only small amounts of steam being necessary in spite of the large amount of added resin. The combination of all these advantages has hitherto not been achieved by any process.

In accomplishing these objects, there has been provided, in accordance with one aspect of the present invention, a process for producing pulped wood fiber material, comprising the steps of (A) treating wood chippings with steam to soften the chippings, (B) thereafter comminuting said chippings to form wood fibers, (C) providing a mixture of said wood fibers with steam and adding to said mixture an aqueous solution containing a thermocurable resin, such that said wood fibers are coated with said resin, and (D) then removing steam from said mixture and drying said wood fibers to a moisture content of less than 12% by weight. In a preferred embodiment, the wood fibers are dried to a moisture content of 3 to 10% by weight.

According to another aspect of the invention, there has been provided process for producing a board comprising the additional step of hot compressing the wood fiber material product of the process described above.

There has also been provided, in accordance with yet another aspect of the present invention, a decorative board comprising a core layer and a single or double-sided decorative layer, in which board the core layer comprises the fiber particles produced in accordance with the process described above. The board is a sheet-like object whose surface form and surface structure are matched to the purpose of application and which can also, for example, have a curved shape. The board is preferably an object having an essentially planar surface. Its thickness is, in particular, in the range of about 0.5 to 30 mm. Boards of this general type are described, in particular in U.S. Pat. No. 4,503,115. The board according to the present invention expediently has a scratch-proof surface, as described in European patent applications No. 01 66 153 and No. 02 16 269.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention is illustrated in greater detail below by reference to the figure. The figure is a schematic representation of process within the present invention.

DETAILED DESCRIPTION OF THE PREFERRED EMBODIMENTS

Pulped cellulose material is taken to mean, in particular, fibrous wood particles. They are produced from types of wood which allow pulping, for example from softwood, such as spruce or pine, or hardwood, such as chestnut or beech. Furthermore, cellulose fibers and industrial wood, paper and cellulose waste, for example, sawdust or ground pulp, can be used in addition to the wood fibers; waste from wood-processing workshops is also suitable. It is also possible to replace part of the wood fibers, the cellulose fibers or the wood waste, preferably up to 20% by weight, by plastic waste, for example in the form of fibers or granules. The wood is washed in order to remove traces of metal, stones or sand and then comminuted in a mill to form wood chippings.

With reference to the figure, wood chippings are fed continuously with approximately an equal amount by weight of water into a vessel 1 and are treated with hot steam in the kettle 2. After a residence time of a few minutes, the softened chippings are transported on to a refiner 3, where they are comminuted between two grinding disks to form wood fibers. The wood fibers are passed on using hot steam in a blow plant 4 into which thermocurable phenol-formaldehyde resin is sprayed in aqueous alkaline solution via the resin injector 5. In the subsequent part, the blow plant 4 is cooled externally using water (cooling jacket 6). The mixture obtained comprising steam and resin-coated wood fibers then passes into a cyclone separator 7 under atmospheric pressure. Here, the steam is removed and fed back via the line 8 to the chippings vessel 1 in order to heat the wood particles. The resin-coated or impregnated wood fibers are fed, for the remaining drying, through a star feeder 9 into a drying tube 10, which they leave with a residual moisture content of 7% by weight. The wood fibers are transported on by the drier air into a cyclone separator 11 and passed through a star feeder into a shaping station 12, where they are deposited on a belt and pre-compressed to form a fiber mat.

The wood chippings are softened in a digester (steam kettle) using steam under a steam pressure of 1 to 10 bar for a few minutes and subsequently comminuted, for example between two grinding disks in a refiner, to form wood fibers.

The wood fibers digested in this way have a length of 0.3 to 20 mm, a mean length of 0.5 to 3 mm and a mean diameter of 0.025 to 0.05 mm. The diameter range is between 0.01 and 1 mm, depending on the raw wood used and the pulping conditions. The length and diameter of the cellulose fibers used are in the same range of dimensions.

The fiber particles emerging from the pulping machine are transported on in the hot steam stream in a blow plant under increased pressure preferably at 2 to 10 bar, in particular 4 to 6 bar, in turbulent flow.

The addition of the thermocurable resin takes place in aqueous solution, preferably an alkaline aqueous solution, which is sprayed into the blow plant. Due to the turbulent flow, caused by appropriately small dimensions of the blow line and a pressure difference applied over the length of the blow line, optimum mixing takes place between the resin and the fiber particles, even in the case of very large amounts of resin, which can amount to 200 to 1000 g, in particular 300 to 600 g, per 1000 g of dry fibers. The thermocurable resin is preferably a phenol-formaldehyde resin, as is customary in the production of decorative building board (see U.S. Pat. No. 4,503,115).

It has proven particularly advantageous to cool the blow plant externally in the region downstream of the resin addition, preferably as far as the removal of steam, so that a thin film of condensed water deposits on the inner wall of the blow plant. For this purpose, it is sufficient for the temperature of the blow plant wall to be reduced by a few degrees, and a temperature reduction of 5 to 20° C. has proven expedient. Adhesion of the resin-coated fiber particles to the inner wall of the blow plant is thus effectively prevented.

The mixture of steam and resin-coated fiber particles is transported by the blow plant to a unit where the steam is removed from the resin-coated fiber particles. In this stage the steam is preferably removed completely. After this, the fiber particles still have a water content of 15 to 35% by weight, in particular 18 to 25% by weight. This stage is advantageously carried out in a cyclone separator at atmospheric pressure, in particular without supply of energy, but other equipment with which systems comprising solid particles, such as, for example, dust and gases can be separated from one another is, in principle, also suitable. Such equipment is, for example, an apparatus which operates on the principle of gravity or centrifugal force and/or is constructed from filters or mechanical separators. See "Dust Collector Design"in PERRY'S CHEMICAL ENGINEERS' HANDBOOK 20-81 to 20-89 (6th ed. 1985), McGraw-Hill Book Company. For energy-saving reasons, the steam removed is fed back into the process and expediently used for warming and softening the wood chippings still to be pulped. It is also possible to remove excess curable resin together with the steam and re-use it.

In the subsequent drying stage, the final moisture content of less than 12% by weight, in particular 3 to 10% by weight, is reached. For this purpose, the fiber particles are expediently blown through a drying tube heated with warm air, the particles being finely divided by the air stream. The warm air preferably has a temperature from 60° to 110° C. The dried fibers leave the drying stage, for example, via a further cyclone separator or similar equipment and are processed further, in particular for the production of decorative building board, as described 1 for, example, in U.S. Pat. No. 4,503,115.

The process of the present invention exhibits a combination of advantages in a surprising manner. Thus, the presence of steam in the drier is substantially prevented, which means that the energy requirement is relatively low. The danger of fire is also significantly reduced. There is no danger of the function of either the blow plant or the drier being impaired by adhering material. The process does not require great equipment expenditure, and additional units for mixing and/or transporting the fiber particles are not necessary. The fibers obtained after the drying stage are not agglomerated, which means that they can easily be molded into compressible fiber mats.

What is claimed is:

1. A process for producing pulped wood fiber material, comprising the steps of
   (A) treating wood chippings with steam to soften the chippings,
   (B) thereafter comminuting said chippings to form wood fibers,
   (C) providing a mixture of said wood fibers with steam, and adding to said mixture an aqueous solution containing a thermocurable resin, such that said wood fibers are coated with said resin, and
   (D) then removing steam from said mixture and subsequently drying said wood fibers to a moisture content of less than 12% by weight.

2. A process according to claim wherein said wood fibers are dried to a moisture content of 3 to 10% by weight.

3. A process according to claim wherein said wood fibers are dried during step (D) with warm air at a temperature between about 60° C. and 110° C.

4. A process according to claim 1, wherein said aqueous solution is an alkaline aqueous solution containing said thermocurable resin.

5. A process according to claim 1, comprising the steps of transporting said wood fibers in a steam stream to a mixing zone, adding said resin to said mixture to coat said fibers, and conveying said mixture through an externally cooled transport line where the steam is removed, and thereafter drying said wood fibers.

6. A process according to claim 5, wherein the steam stream transporting said wood fibers is conveyed under pressure in turbulent flow.

7. A process according to claim 6, wherein said pressure is in the range of 2 to 10 bar.

8. A process according to claim 1, wherein the amount of resin (dry weight) during step (C) is 200 to 1000 g per 1000 g of wood fiber (dry weight).

9. A process according to claim 1, wherein steam removed during step (D) is recirculated and used to soften untreated wood chippings.

10. A process as claimed in claim 1, wherein step (D) comprises drying said wood fibers with dry air and then separating wood fibers from the dry air.

11. A process according to claim 1, comprising comminuting said wood chippings under steam pressure to a maximum fiber length of 20 mm to produce fiber particles, thereafter transporting said fiber particles with steam under pressure to a mixing zone and spraying said aqueous solution into the mixing zone to coat said wood fiber particles with resin.

12. A process for producing pulped wood fiber material as recited in claim 1, further comprising the step of hot compressing said wood fiber material.

* * * * *

UNITED STATES PATENT AND TRADEMARK OFFICE

CERTIFICATE OF CORRECTION

PATENT NO. : 4,937,100

DATED : June 26, 1990

INVENTOR(S) : Lanters, et al.

It is certified that error appears in the above-identified patent and that said Letters Patent is hereby corrected as shown below:

Column 4, Claim 2, line 1, after "A process according to claim" insert -- 1, --.

Column 4, Claim 3, line 1, after "A process according to claim" insert -- 1, --.

Signed and Sealed this

First Day of December, 1992

*Attest:*

*Attesting Officer*

DOUGLAS B. COMER

*Acting Commissioner of Patents and Trademarks*